US009981364B2

(12) United States Patent
Mattson et al.

(10) Patent No.: US 9,981,364 B2
(45) Date of Patent: May 29, 2018

(54) HAND TOOL IMPACTING DEVICE WITH FLOATING PIN MECHANISM

(71) Applicant: BRIGHAM YOUNG UNIVERSITY, Provo, UT (US)

(72) Inventors: Christopher Andrew Mattson, Provo, UT (US); Jake Allred, Provo, UT (US); Jeremy Alsup, Provo, UT (US); Travis Anderson, Provo, UT (US); David Christensen, Provo, UT (US); Jacob Morrise, Provo, UT (US); Jon Ward, Lake Jackson, TX (US)

(73) Assignee: Brigham Young University, Provo, UT (US)

( * ) Notice: Subject to any disclaimer, the term of this patent is extended or adjusted under 35 U.S.C. 154(b) by 408 days.

(21) Appl. No.: 14/793,368

(22) Filed: Jul. 7, 2015

(65) Prior Publication Data

US 2015/0375376 A1 Dec. 31, 2015

Related U.S. Application Data

(63) Continuation of application No. 13/329,249, filed on Dec. 17, 2011, now Pat. No. 9,102,046.

(Continued)

(51) Int. Cl.

*B25B 21/00* (2006.01)
*B25D 16/00* (2006.01)

(Continued)

(52) U.S. Cl.

CPC ..... *B25B 21/023* (2013.01); *B25D 11/102* (2013.01); *B25D 16/00* (2013.01);

(Continued)

(58) Field of Classification Search

CPC ..... B25D 2250/211; B25D 2250/111; B25D 2250/241; B25D 17/02; B25D 17/005;

(Continued)

(56) References Cited

U.S. PATENT DOCUMENTS 701,941 A * 6/1902 Rowlands ..... B25B 23/12 81/451
1,925,289 A * 9/1933 Strobel ..... B25D 11/102 173/109

(Continued)

OTHER PUBLICATIONS boschtools.com, "1" SDS-plus® BULLDOG Xtreme Rotary Hammer", available online at <http://www.boschtools.com/Products/Tools/Pages/BoschProductDetail.aspx?pid=11255vsr>, retrieved on Nov. 18, 2014, 2 pages.

*Primary Examiner* — Stephen F Gerrity
*Assistant Examiner* — Joshua Kotis
(74) *Attorney, Agent, or Firm* — Brake Hughes Bellermann LLP

(57) ABSTRACT

A hand tool impacting device may include, a drive shaft with an aperture, an impaler disk, and a floating pin positioned within the aperture of the drive shaft. A set of circular ramps on the outer edge of the impaler disk may interact with a stationary pin insert to translate the drive shaft and create an impacting motion. A pair of springs placed against either side of the floating pin may allow a specialized tool bit to engage or disengage the impaler disk, thereby allowing selective use of translational impacting motion, or rotational torque. An impact bit for engaging the impaler disk may include, a tool head configured to engage a work piece and a tool shaft configured to be inserted into a hollow drive shaft to engage a floating pin. According to one embodiment, the impact bit includes a number of sleeves to guide the tool head during operation.

18 Claims, 8 Drawing Sheets

Related U.S. Application Data

(60) Provisional application No. 61/459,872, filed on Dec. 20, 2010.

(51) Int. Cl.

| | |
|---|---|
| ***B25D 17/08*** | (2006.01) |
| ***B25B 21/02*** | (2006.01) |
| ***B25D 17/02*** | (2006.01) |
| ***B25D 17/00*** | (2006.01) |
| ***B25D 11/10*** | (2006.01) |

(52) U.S. Cl.

CPC ..... *B25D 17/005* (2013.01); *B25D 17/02* (2013.01); *B25D 17/088* (2013.01); *B25D 2217/0034* (2013.01); *B25D 2250/371* (2013.01)

(58) Field of Classification Search

CPC .... B25D 2217/0003; B25D 2217/0007; B25D 2217/0034; B25D 11/04; B25D 11/02; B25D 11/10–11/108; B25D 11/068; B25D 2211/062; B25D 2211/064; B25D 16/00; B25D 16/003; B25D 16/006; B25D 2216/0084; B25D 2216/0023; B25D 2216/0092; B25D 17/088; B25B 21/026; B25B 21/023; B25B 21/007

USPC ..... 173/48, 47, 90

See application file for complete search history.

(56) References Cited

U.S. PATENT DOCUMENTS

| | | | | | |
|---|---|---|---|---|---|
| 2,029,326 | A | * | 2/1936 | Lembke | B25D 11/104 173/118 |
| 2,825,436 | A | | 3/1958 | Amtsberg | |
| 2,881,884 | A | | 4/1959 | Amtsberg | |
| 2,889,711 | A | | 6/1959 | Morris | |
| 3,203,490 | A | * | 8/1965 | Short | B25D 16/00 173/109 |
| 3,256,946 | A | * | 6/1966 | Jansen | B25D 11/102 173/115 |
| 3,599,765 | A | * | 8/1971 | Turner | B25B 21/007 192/56.61 |
| 3,613,751 | A | * | 10/1971 | Juhasz | B25B 21/00 192/150 |
| 3,834,468 | A | | 9/1974 | Hettich et al. | |
| 3,931,744 | A | | 1/1976 | Wunsch | |
| 4,346,767 | A | | 8/1982 | Vaughan | |
| 4,378,053 | A | | 3/1983 | Simpson | |
| 4,489,792 | A | | 12/1984 | Fahim et al. | |
| 4,712,625 | A | * | 12/1987 | Kress | B25D 16/00 173/104 |
| 4,898,250 | A | | 2/1990 | Neumaier et al. | |
| 5,060,733 | A | * | 10/1991 | Kress | B25B 21/00 173/13 |
| 5,199,505 | A | | 4/1993 | Izumisawa | |
| 5,427,188 | A | * | 6/1995 | Fisher | B25D 11/102 173/205 |
| 5,653,294 | A | | 8/1997 | Thurler | |
| 5,794,325 | A | | 8/1998 | Fallandy | |
| 5,996,452 | A | * | 12/1999 | Chiang | B25B 15/001 279/157 |
| 6,192,996 | B1 | | 2/2001 | Sakaguchi et al. | |
| 6,913,090 | B2 | | 7/2005 | Droste et al. | |
| 7,131,503 | B2 | | 11/2006 | Furuta et al. | |
| 7,987,920 | B2 | | 8/2011 | Schroeder et al. | |
| 2006/0024141 | A1 | | 2/2006 | Schad | |
| 2006/0278417 | A1 | | 12/2006 | Hahn | |
| 2008/0035360 | A1 | | 2/2008 | Furuta | |
| 2011/0100662 | A1 | | 5/2011 | Wei | |

* cited by examiner

HAND TOOL IMPACTING DEVICE WITH FLOATING PIN MECHANISM

RELATED APPLICATIONS

This application is a continuation of U.S. application Ser. No. 13/329,249, filed Dec. 17, 2011, which claims the benefit of and priority to U.S. Provisional Application No. 61/459,872, filed Dec. 20, 2010, the contents of each are hereby incorporated by reference in their entireties.

BACKGROUND OF THE INVENTION

Field of the Invention

This invention relates generally to hand power tools and more particularly relates to an apparatus for creating an impacting motion in a powered hand tool.

Description of the Related Art

Hand drills are rotary tools that impose a rotational force onto a screw bit to drive a screw into a medium. Similarly, hand impact devices use a repeated translational impacting motion to drive a nail into a medium. Often times a project requires the use of both devices, which would require different tools. Delivering both a translational impact force and a rotational force in a single tool would therefore provide advantages that are lacking in currently available hand tools.

SUMMARY OF THE INVENTION

The present invention has been developed in response to the present state of the art, and in particular, in response to the problems and needs in the art that have not yet been fully solved by currently available impact devices. Accordingly, the present specification has been developed to provide an apparatus that allows a user the functionality of a rotary drill and an impact hammer in a single impacting device that overcomes many of the shortcomings in the art.

As described below, a hand tool impacting device may include, a rotating hollow drive shaft that has an aperture extending through a portion of its diameter, an impaler disk coupled to translate with the drive shaft, and a floating pin positioned within the aperture of the drive shaft that is configured to rotate the impaler disk along with the drive shaft. While engaged to the drive shaft, a set of circular ramps on the outer edge of the impaler disk may interact with a stationary pin insert to create a repeating impact motion. In one embodiment a pair of springs placed against either side of the floating pin may allow a specialized tool bit to engage or disengage the impaler disk, thereby allowing selective use of an impacting motion.

Additionally, as described below an impact bit for engaging the impaler disk may include, a tool head configured to engage a work piece and a tool shaft configured to be inserted into a tool chuck, and a tool shank that extends into a hollow drive shaft to engage a floating pin. According to one embodiment, the impact bit includes a plurality of sleeves to guide the tool head during operation.

The present invention provides a variety of advantages. It should be noted that references to features, advantages, or similar language within this specification does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

The aforementioned features and advantages of the present invention will become more fully apparent from the following description and appended claims, or may be learned by the practice of the invention as set forth hereinafter.

BRIEF DESCRIPTION OF THE DRAWINGS

To enable the advantages of the invention to be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Figure 1:
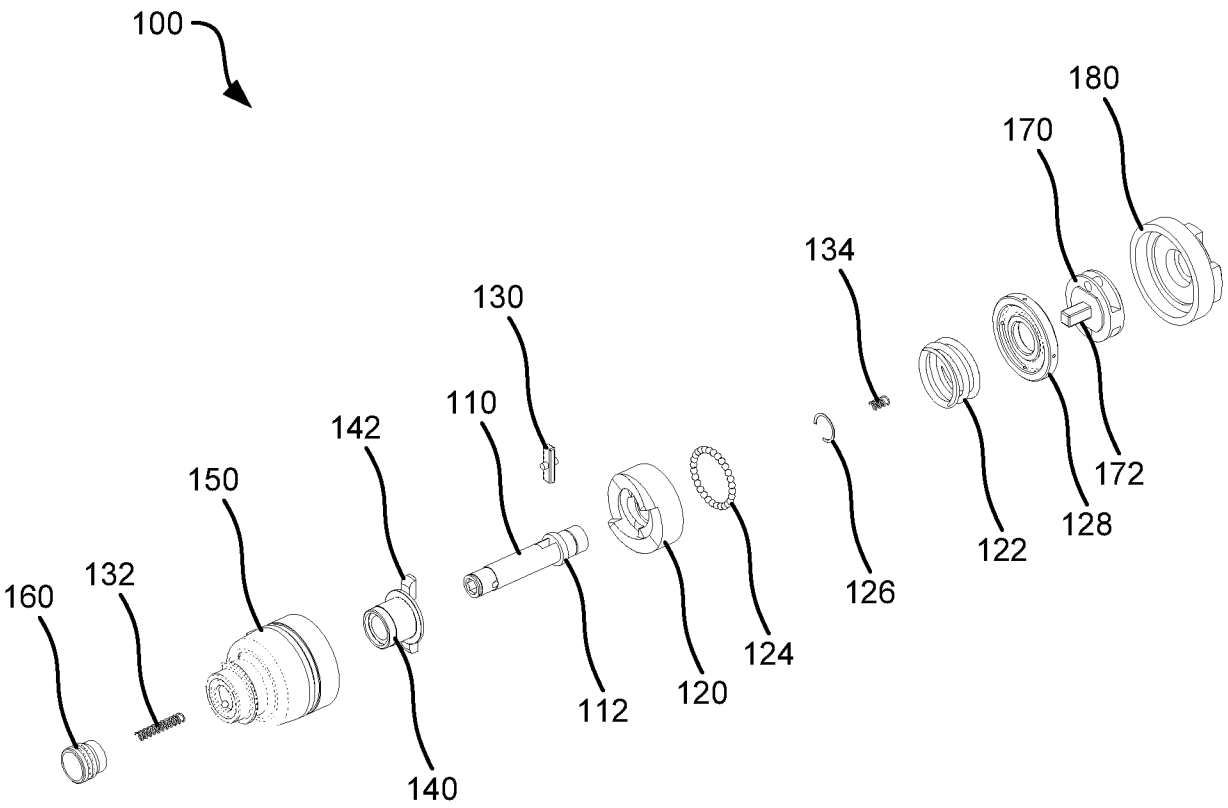
FIG. 1 is an exploded perspective view illustration of one embodiment of an impact device of the present specification suitable for a powered hand tool.

FIG. 1 is an exploded perspective view of one embodiment of an impacting device 100 of the present specification. As depicted, the impact device 100 may include a tool chuck 160, a housing 150, a pin insert 140 with raised pins 142, a hollow drive shaft 110, a floating pin 130 with a distal spring 132 and a proximal spring 134, an impaler disk 120, a coupling plate 170, and a backing plate 180.

In one embodiment, the impact device 100 may include a hollow drive shaft 110 which is configured to rotate. The hollow drive shaft 110 may include an aperture in which a floating pin 130 is positioned. The impact device 100 may also include an impaler disk 120 that is coaxial to the hollow drive shaft 110 and coupled to translate longitudinally with the drive shaft 110. According to one embodiment, a snap ring 126 and a circular protrusion 112 of the hollow drive shaft 110 ensure the impaler disk is coupled to translate with the drive shaft. The impaler disk 120 may be selectively coupled to the drive shaft 110 using the floating pin 130 such that when coupled, the impaler disk rotates with the drive shaft. Bearings 124 may be placed between the impaler disk 120 and the hollow drive shaft 110 to maintain the impaler disk stationary when not coupled to the drive shaft.

The impact device may also include a pin insert 140 with a plurality of raised pins 142. The pin insert 140 and raised pins 142 may remain stationary during the operation of the impact device 100. With the impaler disk 120 engaged, the plurality of raised pins 142 create a impacting motion.

One embodiment of the impacting device 100 includes a distal spring 132 and a proximal spring 134 that are configured to position the floating pin 130 within the aperture of the hollow drive shaft 110. In one example the springs 132, 134 align the floating pin 130 such that it does not engage the impaler disk 120. In another example the springs 132, 134 align the floating pin to engage the impaler disk 120. In this example the floating pin 130 is coupled to the impaler disk 120 which causes it to rotate with the drive shaft 110.

The impact device 100 may also include a coupling plate 170 that connects the hollow drive shaft 110 to an external power supply (not shown). In one embodiment an external power supply causes the coupling plate 170 to rotate. The coupling plate 170 may include a connecting shaft 172 that is configured to be inserted into the hollow drive shaft 110. This connecting shaft 172 transmits the rotational motion from the power supply to the drive shaft. 110. The connecting shaft 172 also allows the hollow drive shaft 110 to translate along its length.

The impact device 100 may also include a backing plate 180 that is configured to attach the impact device 100 to a hand power tool. One embodiment of the impact device 100 includes a tool chuck 160 configured to receive a tool bit. Tool bits that may be used include, but are not limited to a screw driver, a drill bit, a chisel, a punch, and a flat surface for pounding a nail into a medium. The impact device 100 may also include a housing 150 that encloses the impact device.

Figure 2A:
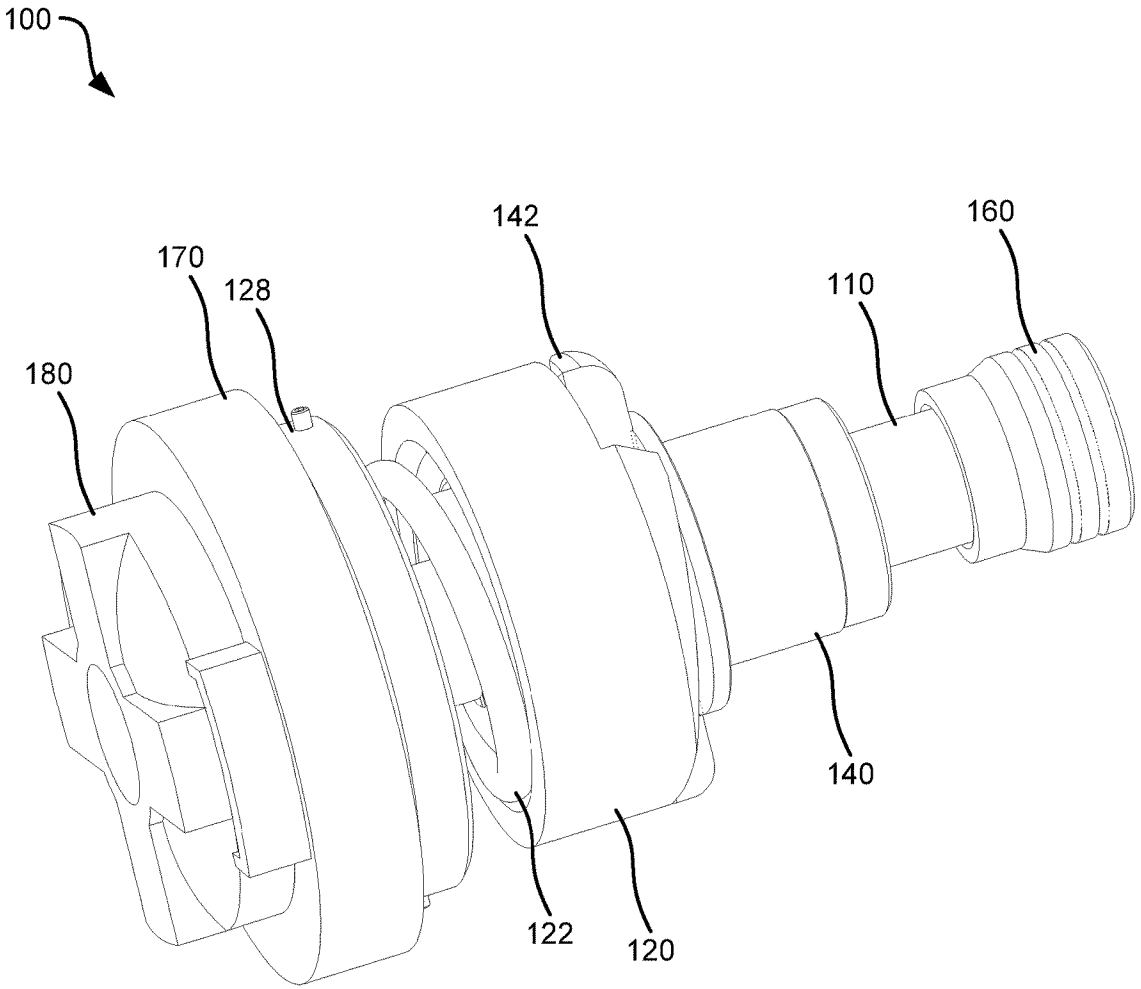
FIGS. 2*a* and 2*b* are perspective view illustrations of one embodiment of an assembled impact device of the present specification suitable for a powered hand tool.

FIG. 2*a* is a perspective view illustration of one embodiment of an assembled impact device 100. As depicted the assembled impact device 100 may include the tool chuck 160, the hollow drive shaft 110, pin insert 140 with raised pins 142, the impaler disk 120, the impaler spring 122, the impaler plate 128, the coupling plate 170, and the backing plate 180.

Figure 2B:
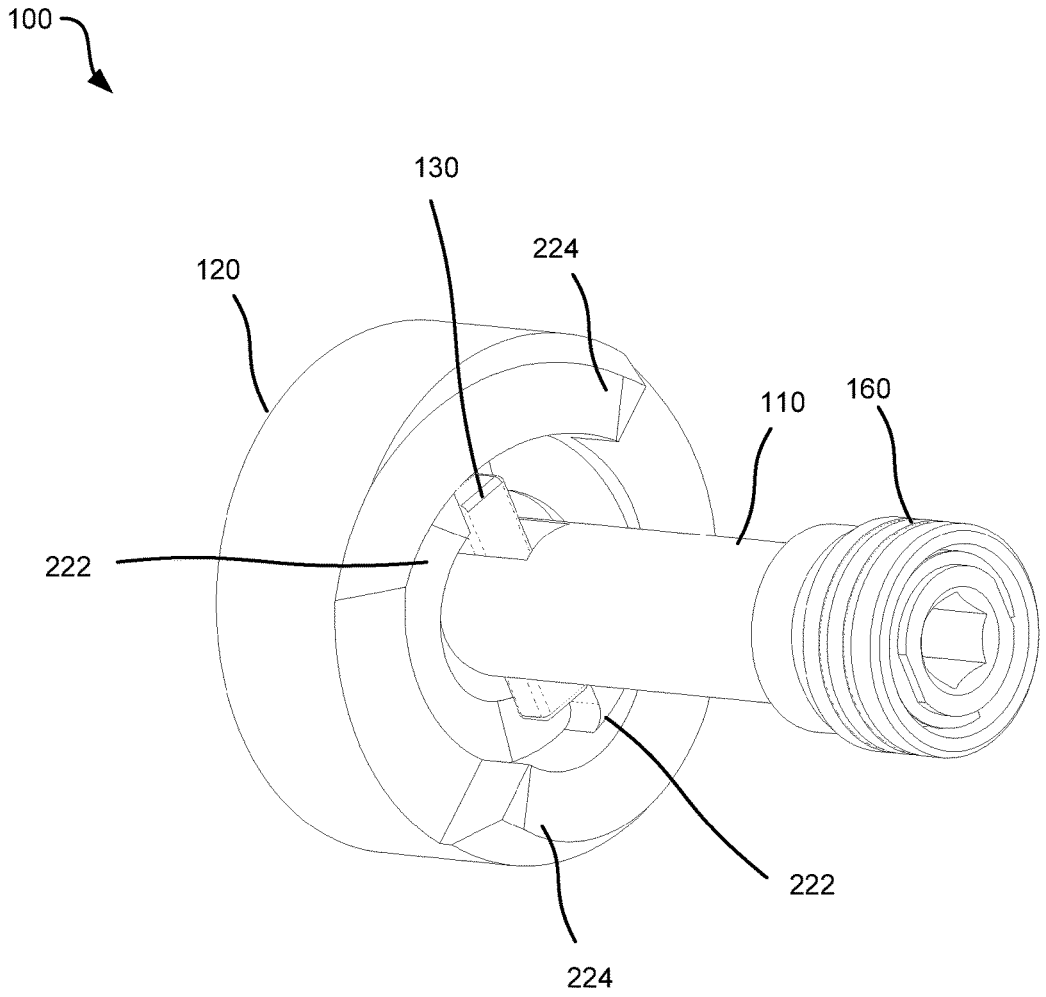

FIG. 2*b* is a perspective view illustration of one embodiment of an assembled impact device 100. As depicted the assembled impact device includes the tool chuck 160, the hollow drive shaft 110, the floating pin 130, and the impaler disk 120.

In one embodiment the impaler disk 120 may include a first plurality of circular ramps 222 which are positioned on the inner edge of a surface of the impaler disk 120. In this embodiment, a portion of the floating pin 130 may extend beyond the diameter of the hollow drive shaft 110. A shaft inserted into the hollow drive shaft 110 may position the extended portion of the floating pin 130 against the flat surface of the first plurality of circular ramps 222. In this fashion, as the hollow drive shaft 110 rotates in a counter clockwise direction, the floating pin 130 exerts a force against the flat surface of the first plurality of circular ramps 222 causing the impaler disk 120 to rotate with the drive shaft. In another mode of operation, as the drive shaft 110 rotates in a clockwise direction, the floating pin 130, slides along the incline of the first plurality of circular ramps 222. In this mode of operation the impaler disk 120 does not rotate with the drive shaft 110.

The impaler disk 120 may also include a second plurality of circular ramps 224 which are positioned on the outer edge of a surface of the impaler disk 120. With the impaler disk 120 rotationally coupled to the drive shaft 110, the second plurality of circular ramps 224 may interact with the stationary raised pins 142. The stationary raised pins 142 cause the impaler disk 120 and drive shaft 110 to translate backwards compressing the impaler spring 126 against the impaler plate 128. As the raised pins 142 slide off the flat surface of the second plurality of circular ramps 224, the impaler spring 126 forces the impaler disk 120 and drive shaft 110 forward, thus creating a translational impacting motion.

Figure 3A:
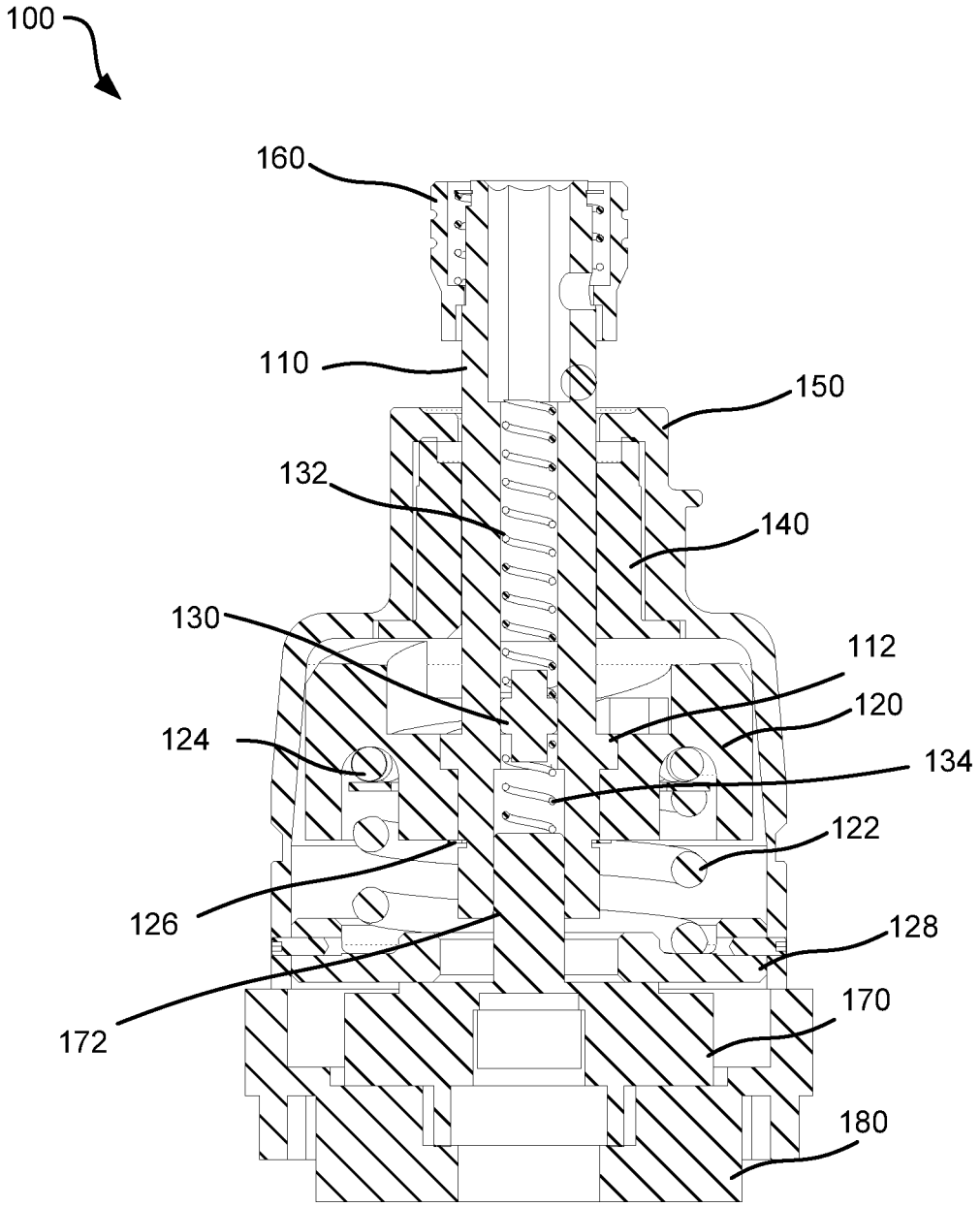
FIGS. 3*a* and 3*b* are detailed sectional side view illustrations of one embodiment of an impact device of the present specification suitable for a powered hand tool.
Figure 3B:
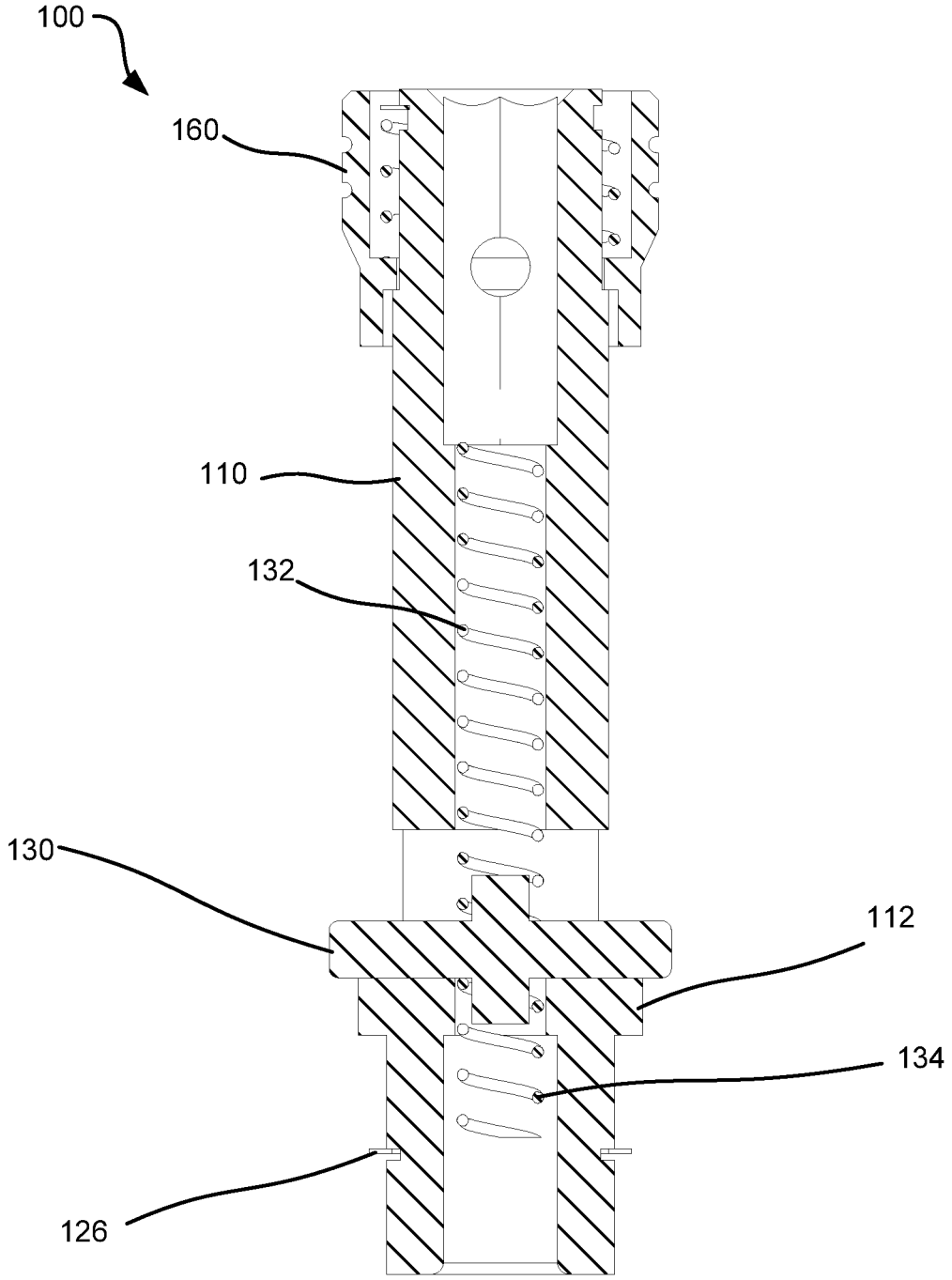

FIGS. 3*a* and 3*b* are detailed sectional side view illustrations of one embodiment of an impact device of the present specification 100. As depicted in FIG. 3*b*, in one example the distal spring 132 and the proximal spring 134 are positioned such that the floating pin 130 is not coupled to the impaler disk 120 and the impaler disk is not rotating with the drive shaft 110. In another example, a tool shank inserted into the hollow drive shaft 110 positions the floating pin 130 such that it is coupled to the impaler disk 120 which causes the impaler disk to rotate with the drive shaft 110.

Figure 4:
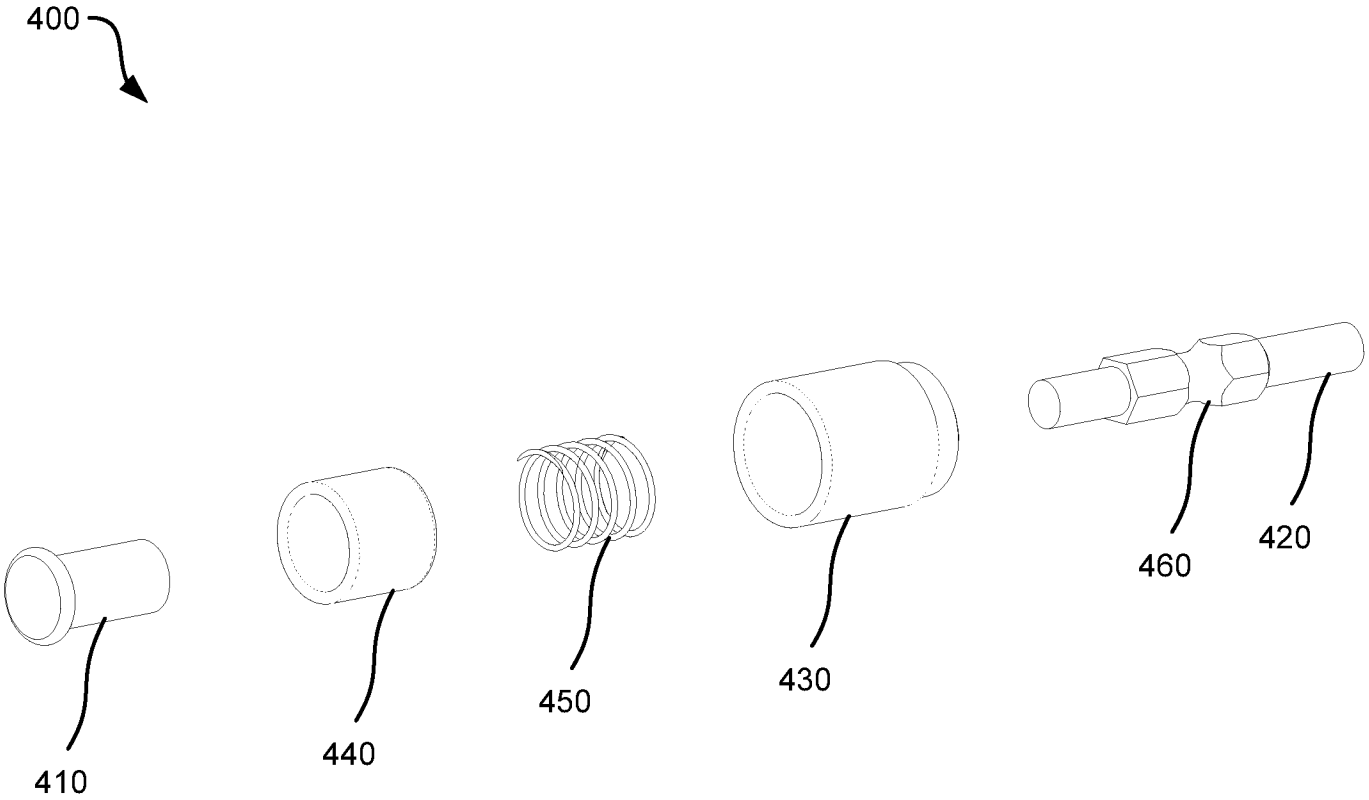
FIG. 4 is an exploded perspective view illustration of one embodiment of an impact bit of the present specification suitable for a powered hand tool.

FIG. 4 is an exploded perspective view illustration of one embodiment of an impact bit of the present specification 400. As depicted the impact bit may include a tool shaft 460, a tool shank 420, an outer sleeve 430, a sleeve spring 450, an inner sleeve 440, and a tool head 410.

In one embodiment, the impact bit 400 may be configured to be inserted into a tool chuck 160, as shown in FIGS. 1 through 3*b*. In this embodiment, the tool shank 420 may be configured to extend down the hollow drive shaft 110 and position the floating pin 130 against the impaler disk 120.

The impact bit 400 may also include a tool head 410 to interact with a fastener. In one example the tool head 410 is a flat surface that is configured to pound a nail into a medium. Other examples of tool heads 410 that may be used include but are not limited to, a screwdriver, a drill bit, and a chisel. The impact bit 400 may also include an outer sleeve 430 that extends beyond the tool head 410 to align the tool head with the fastener. The impact bit may also include a retractable inner sleeve 440 that extends beyond the outer sleeve 430. A sleeve spring 450 allows the inner sleeve 440 to retract into the outer sleeve 430. For example, the inner sleeve 440 may retract into the outer sleeve 430 as it is pressed against the medium into which the fastener is being driven.

Figure 5:
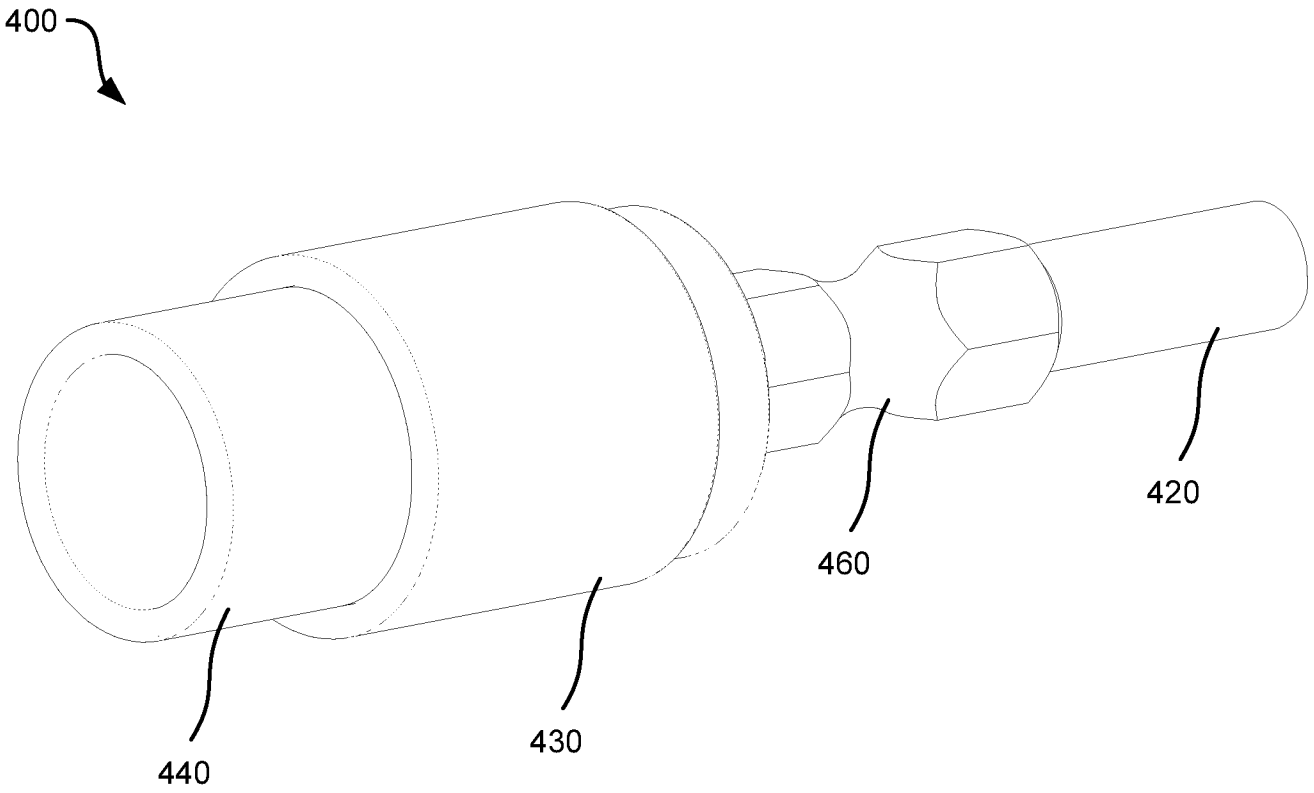
FIG. 5 is a perspective view illustration of one illustration of one embodiment of an assembled impact bit of the present specification suitable for a powered hand tool.

FIG. 5 is a perspective view illustration of one illustration of one embodiment of an assembled impact bit 400 of the present specification. As depicted the assembled impact bit 400 may include the tool shank 420, the tool shaft 460, the outer sleeve 430, and the inner sleeve 440.

Figure 6:
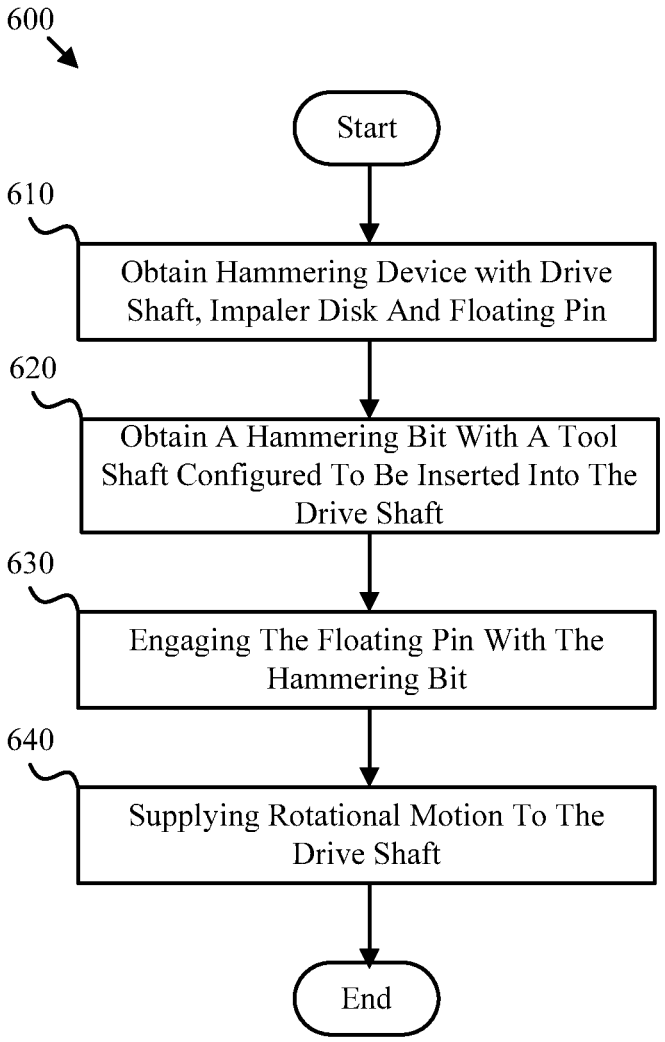
FIG. 6 is a flowchart diagram of one embodiment of an impacting method of the present invention.

FIG. 6 is a flowchart diagram of one embodiment of an impacting method 600 of the present invention. As depicted, the impacting method 600 includes obtaining 610 an impacting device, obtaining 620 an impact bit, engaging 630 the floating pin with the impact bit, and supplying 640 rotational motion to the drive shaft. The depicted method may be conducted in conjunction with the impacting device 100 and impact bit 400 or the like.

Obtaining 610 a impacting device may include obtaining a device comprising a hollow drive shaft with an aperture, an impaler disk coupled to translate longitudinally with the drive shaft, and a floating pin positioned within the aperture. The impaler disk may include a first plurality of circular ramps used to rotationally couple the impaler disk to the drive shaft. The impaler disk may also include a second plurality of circular ramps that create an impacting motion. In one embodiment, the obtained impacting device is the impacting device 100.

Obtaining 620 an impact bit may include obtaining a device comprising a tool head configured to engage a work piece, a tool shaft configured to be inserted into a tool chuck, and a tool shank configured to extend into a hollow drive shaft to engage an impacting device. In one embodiment, the obtained impact bit may be the impact bit 400.

The method may continue by engaging 630 the floating pin with the impact bit. This is done as the impact bit is inserted into the impacting device. In one embodiment the impact bit is configured to extend into the impacting device to engage the floating pin of the impacting device to create a translational impacting motion.

With the impact bit inserted into the impacting device, the method may continue by supplying 640 rotational motion to the drive shaft of the impacting device. In one example this rotational motion is supplied by an electric motor positioned within a powered hand tool.

The present invention provides an improved impacting device hand power tool and drive train. The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A hand tool, comprising:

an impacting device configured to be operably coupled to an external power source, the impacting device including:

a hollow drive shaft;

an impaler disk coaxially aligned with the drive shaft, the impaler disk including an impacting surface including a plurality of first ramps and a plurality of second ramps; and a floating pin extending radially through the drive shaft;

a tool chuck coupled to a distal end of the drive shaft; and an impact bit removably coupled in the tool chuck, the impact bit including:

a tool shaft coupled to the tool chuck;

a tool head coupled to a distal end of the tool shaft and configured to engage a work piece; and a tool shank extending from a proximal end of the tool shaft, wherein the tool shank extends into the hollow drive shaft to engage the floating pin, the floating pin engaging the impacting surface of the impaler disk in response to engagement of the tool shank and the floating pin, and, in response to rotation of the hollow drive shaft in a first direction, a first end portion of the floating pin is positioned against a flat step surface of a first ramp of the plurality of first ramps of the impaler disk, and a second end of the floating pin is positioned against a flat step surface of a second ramp, of the plurality of first ramps, of the impaler disk, such that the impaler disk rotates together with the drive shaft.

2. The hand tool of claim 1, wherein the tool head includes:

a tool head shaft; and a planar impacting surface at a distal end of the tool head shaft.

3. The hand tool of claim 2, wherein the impact bit also includes:

an outer sleeve having a proximal end coupled to the tool shaft;

an inner sleeve coaxially coupled to the outer sleeve, a portion of the inner sleeve extending out of the outer sleeve, beyond a distal end of the outer sleeve; and a sleeve spring positioned in the outer sleeve.

4. The hand tool of claim 3, wherein the sleeve spring is positioned between a proximal end of the inner sleeve and the distal end of the tool shaft.

5. The hand tool of claim 4, wherein the tool head is positioned within the outer sleeve such that the sleeve spring and the outer sleeve surround the tool head.

6. The hand tool of claim 5, wherein the portion of the inner sleeve extending out of the outer sleeve is moved to a position within the outer sleeve in response to compression of the sleeve spring.

7. The hand tool of claim 5, wherein the inner sleeve is configured to reciprocate within the outer sleeve in response to engagement of the tool shank with the floating pin, and engagement of the floating pin with the impacting surface of the impaler disk.

8. The hand tool of claim 3, wherein the tool shaft includes:

a first section having a polygonal cross section;

a second section having a polygonal cross section; and a transition section connecting the first section and the second section.

9. The hand tool of claim 8, wherein the first section of the tool shaft is coupled to the tool chuck, the second section of the tool shaft is coupled to the tool head and the outer sleeve, and the tool shank extends outward from the first section of the tool shaft.

10. The hand tool of claim 1, wherein the plurality of first ramps are arcuate and are arranged along an inner peripheral edge of the impacting surface of the impaler disk, and the plurality of second ramps are arcuate and are arranged along an outer peripheral edge of the impacting surface of the impaler disk, surrounding the plurality of first ramps.

11. The hand tool of claim 10, wherein, in response to engagement of the tool shank and the floating pin and rotation of the hollow drive shaft in a second direction, the first end of the floating pin and the second end of the floating pin each move along an inclined surface of a respective first ramp of the plurality of first ramps, then down the flat step surface of the respective first ramp of the plurality of first ramps, and then along the inclined surface and flat stepped surface of subsequent adjacent first ramps, such that the hollow drive shaft rotates independent of the impaler disk.

12. The hand tool of claim 1, further comprising:

a housing that encompasses the hollow drive shaft, impaler disk, and floating pin; and a backing plate attached to an open end of the housing and configured to attach the housing to a tool shell.

13. The hand tool of claim 1, wherein the hollow drive shaft is configured to be coupled to a motor and a drive train so as to receive a rotational force generated by the motor.

14. A hand tool, comprising:

an impacting device configured to be received in a tool shell, and configured to receive a driving force from a motor received in the tool shell, the impacting device including:

an impaler disk coaxially aligned with a hollow drive shaft;

wherein the impaler disk comprises a plurality of first arcuate ramps and a plurality of second arcuate ramps concentrically arranged on an impacting surface; and a floating pin extending radially through the drive shaft, the floating pin selectively engaging the plurality of first arcuate ramps of the impaler disk in response to engagement of the floating pin with a tool shank of an impact bit;

a tool chuck coupled to the impacting device; and the impact bit coupled to the tool chuck, the tool chuck transferring the driving force from the impacting device to the impact bit, the impact bit including:

a tool shaft coupled to the tool chuck, the tool shaft including:

a first section having a polygonal cross section, the first section engaging the tool chuck; and a second section having a polygonal cross section;

a tool head coupled to the second section of the tool shaft and configured to engage a work piece;

an outer sleeve coupled to the second section of the tool shaft and surrounding the tool head;

an inner sleeve positioned within the outer sleeve and surrounding the tool head; and the tool shank extending outward from the first section of the tool shaft, and into the hollow drive shaft of the impacting device so as to engage the floating pin of the impacting device.

15. The hand tool of claim 14, wherein the impact bit also includes:

a sleeve spring positioned in the outer sleeve, surrounding the tool head, between a proximal end of the inner sleeve and the second section of the tool shaft, wherein the inner sleeve is configured to reciprocate within the outer sleeve in response to engagement of the tool shank with the floating pin, and engagement of the floating pin with the impacting surface of the impaler disk.

16. The hand tool of claim 15, wherein, in response to engagement of the tool shank and the floating pin and rotation of the hollow drive shaft in a first direction, a first end of the floating pin is positioned against a flat step surface of a first ramp of the plurality of first ramps, and a second end of the floating pin is positioned against the flat step surface of a second ramp of the plurality of first ramps such that the impaler disk rotates together with the drive shaft, and in response to engagement of the tool shank and the floating pin and rotation of the hollow drive shaft in a second direction, the first end of the floating pin and the second end of the floating pin each move along an inclined surface of a respective first ramp of the plurality of first ramps, then down the flat step surface of the respective first ramp of the plurality of first ramps, and then along the inclined surface and flat stepped surface of subsequent adjacent first ramps such that the hollow drive shaft rotates independent of the impaler disk.

17. The hand tool of claim 14, wherein the tool head includes:

a tool head shaft; and a planar impacting surface at a distal end of the tool head shaft.

18. The hand tool of claim 14, wherein a cross section of the tool shank is substantially circular, and a diameter of the tool shank is less than a corresponding cross sectional dimension of the first section of the tool shaft.

* * * * *